United States Patent [19]

Imaizumi et al.

[11] 4,150,980

[45] Apr. 24, 1979

[54] ALUMINUM ALLOY EXCELLENT IN HIGH-TEMPERATURE SAGGING RESISTANCE AND SACRIFICIAL ANODE PROPERTY

[75] Inventors: Shigetake Imaizumi, Susono; Kazuo Yamada, Mishima; Katashi Katsumata, Susono, all of Japan

[73] Assignee: Mitsubishi Aluminum Kabushiki Kaisha, Tokyo, Japan

[21] Appl. No.: 910,212

[22] Filed: May 30, 1978

[51] Int. Cl.[2] ..... C22C 21/10

[52] U.S. Cl. ..... 75/146; 148/32

[58] Field of Search ..... 75/146, 141; 148/32, 148/32.5

[56] References Cited

U.S. PATENT DOCUMENTS 3,878,871 4/1975 Anthony et al. ..... 75/146

*Primary Examiner*—R. Dean

*Attorney, Agent, or Firm*—Frishauf, Holtz, Goodman & Woodward

[57] ABSTRACT

An aluminum alloy excellent in the high-temperature sagging resistance and the sacrificial anode property, which consists essentially of, in weight percentage:

Zinc: from 0.5 to 8.0%,

Manganese: from 0.5 to 1.5%, and the balance aluminum and incidental impurities; said alloy including an aluminum alloy also containing zirconium of from 0.01 to 0.5% in weight percentage. Said alloys are particularly adapted to be used as fin materials for tubes in a heat exchanger such as a radiator and a condenser.

2 Claims, 2 Drawing Figures

ALUMINUM ALLOY EXCELLENT IN HIGH-TEMPERATURE SAGGING RESISTANCE AND SACRIFICIAL ANODE PROPERTY

REFERENCE TO PATENTS, APPLICATIONS AND PUBLICATIONS PERTINENT TO THE INVENTION

So far as we know, there is available no document pertinent to the present invention.

FIELD OF THE INVENTION

The present invention relates to an aluminum alloy excellent in the high-temperature sagging resistance and the sacrificial anode property, particularly adapted to be used as a fin material of tubes for such heat exchangers as radiators and condensers.

BACKGROUND OF THE INVENTION

A plurality of fins comprising thin sheets are provided on outer surfaces of tubes which are members constituting a heat exchanger such as a radiator for a motercycle or an automobile, or a condenser for a cooler, in order to increase the radiating surface area of the tube. When a tube is made of copper, aluminum or alloys thereof, it is the usual practice to use, as the fin material, sheets of 1050 aluminum (aluminum with a purity of at least 99.5%) of the AA Standard (the Standards of the Aluminum Association), 3003 alloy (Al-1.2% Mn alloy) of said Standard, or 7072 alloy (Al-1.2% Zn alloy) of said Standard, or clad sheets manufactured by applying a brazing metal sheet to one or both sides of these sheets.

Various methods are available for installing fins of any of the aforementioned materials on the outer surface of a tube of any of the aforementioned materials. Among such various methods, the vacuum brazing method for brazing many joints at a time is widely adopted in the industry, which comprises: tacking a plurality of fins substantially vertically at prescribed intervals onto the outer surface of a tube by the use of an appropriate jig to form an assembly, at least one of the outer surface of said tube, and the both surfaces or one surface of said fin being previously applied with a brazing metal sheet; heating said assembly to a temperature of from about 580 to about 620° C. in a vacuum furnace to melt said brazing metal, thereby brazing said plurality of fins to the outer surface of said tube with said melted brazing metal at a time by a single heating.

In general, when a heat exchanger comprising tubes made of aluminum or an aluminum alloy is used in a corrding environment such as a wet atmosphere, the tubes are rapidly corroded, thus reducing the service life of the heat exchanger. In such a case, therefore, the 7072 alloy (Al-1.2% Zn alloy) of AA Standard mentioned above having a relatively high sacrificial anode property is most commonly employed as the fin material to provide the tube with a cathodic protection with fins as sacrificial anodes.

However, when fins of the 7072 alloy of AA Standard are brazed to the outer surface of the tube by the aforementioned vacuum brazing method, the fins sag down and deform under the effect of external forces and their own weight, because of the low high-temperature sagging resistance of the 7072 alloy of AA Standard, and as a result, the fins cannot hold their original shape upon forming the assembly. In addition, the vacuum atmosphere and the high temperature involved during the vacuum brazing cause a considerable portion of the zinc content of the 7072 alloy of AA Standard to evaporate. When manufacturing a large-capacity heat exchanger, in particular, the necessity of holding a high temperature for a long period at time leads to a very large amount of evaporation of the zinc content. Accordingly, the sacrificial anode property of the fin is seriously impaired or even lost, resulting in corroded tubes in service, this often reducing the service life of the heat exchanger.

SUMMARY OF THE INVENTION

An object of the present invention is therefore to provide an aluminum alloy particularly adapted to be used as a fin material for a tube of a heat exchanger such as a radiator and a condenser.

The principal object of the present invention is to provide an aluminum alloy adapted to be used as a fin material, which is excellent in the high-temperature sagging resistance required for preventing fins from sagging and being deformed, when brazing a plurality of fins at a time onto the outer surface of said tube by the vacuum brazing method, under the effect of a high temperature in a vacuum furnace, and of which the sacrificial anode property for cathodically protecting said tube is not impaired by the vacuum atmosphere and the high temperature in said vacuum furnace.

In accordance with one of the features of the present invention, there is provided an aluminum alloy excellent in the high-temperature sagging resistance and the sacrificial anode property, which consists essentially of, in weight percentage:

Zinc: from 0.5 to 8.0%,

Manganese: from 0.5 to 1.5%, and the balance aluminum and incidental impurities; said alloy including an aluminum alloy also containing zirconium of from 0.01 to 0.5% in weight percentage; said alloys being particularly adapted to be used as fin materials for tubes of a heat exchanger such as a radiator and a condenser.

DETAILED DESCRIPTION OF PREFERRED EMBODIMENTS

Figure 1:
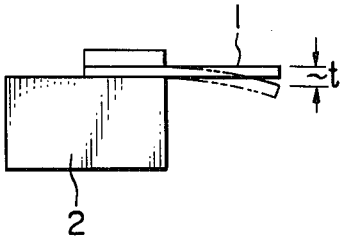
FIG. 1 is a schematic side view illustrating a method for testing the high-temperature sagging resistance of a fin material.

From the aforementioned point of view, we have carried out intensive studies to obtain an aluminum alloy particularly adapted to be used as a fin material for a tube, a member composing a heat exchanger such as a radiator and a condenser, made of copper, aluminum or an alloy thereof. As a result, we have found that an aluminum alloy which consists essentially of, in weight percentage:

Zinc: from 0.5 to 8.0%,

Manganese: from 0.5 to 1.5%, and the balance aluminum and incidental impurties, and also containing, as required, Zirconium from 0.01 to 0.5% is excellent in the high-temperature sagging resistance and the sacrificial anode property and is hence adapted to be used as a fin material as mentioned above.

Now, the reasons for limiting the ranges of the chemical compositions of the alloy of the present invention are given below:

(1) Zinc

It is known that zinc has a function of rendering less noble the anode potential of an aluminum alloy and thus improving the sacrificial anode property of said aluminum alloy.

However, a zinc content of under 0.5 wt.% is too low to ensure a desired excellent sacrificial anode property of the aluminum alloy. It is therefore necessary that the zinc content should be at least 0.5 Wt.%. On the other hand, if the zinc content is over 8.0 wt.%, not only the high-temperature sagging resistance worsens, but also the melting point is decreased to cause partial melting sometimes during high-temperature heating at the time of vacuum brazing. Consequently, the zinc content should be up to 8.0 wt.%.

(2) Manganese

Manganese has a function of improving the high-temperature sagging resistance of an aluminum alloy as well as of preventing the decrease in the sacrificial anode property of the aluminum alloy by inhibiting evaporation of the zinc content under the effect of a vacuum atmosphere and a high-temperature during the vacuum brazing. One of the features of the aluminum alloy of the present invention lies in that the manganese content is in coexistence with the zinc content.

However, a manganese content of under 0.5 wt.% cannot ensure a desired effect as mentioned above. It is therefore necessary that the manganese content should be at least 0.5 wt.%. On the other hand, a manganese content of over 1.5 wt.% cannot give a particular increase in the aforementioned effect, only causing a loss in economics. The manganese content should therefore be up to 1.5 wt.%.

(3) Zirconium

Coexistence of zirconium and manganese gives an additional effect of further improving the high-temperature sagging resistance of an aluminum alloy. Zirconium is added therefore, as required, to the aluminum alloy of the present invention.

However, a zirconium content of under 0.01 wt.% cannot give an improving effect of the high-temperature sagging resistance of the aluminum alloy. It is therefore necessary that the zirconium content should be at least 0.01 wt.%. On the other hand, a zirconium content of over 0.5 wt.% gives no improving effect as mentioned above of the high-temperature sagging resistance, giving no merit in economics. The zirconium content should therefore be up to 0.5 wt.%.

Now, the aluminum alloy of the present invention is described more in detail in comparison with a reference alloy by means of some examples.

EXAMPLE

Cast ingots with a length of 2,000 mm, a width of 900 mm and a thickness of 450 mm of the following aluminum alloys (a) through (c):

(a) An Al-1.5% Zn-1.0% Mn alloy (hereinafter referred to as the "alloy A of the present invention");
(b) An Al-1.5% Zn-1.0% Mn-0.1% Zr alloy (hereinafter referred to as the "alloy B of the present invention"); and
(c) An Al-1.2% Zn alloy (hereinafter referred to as the "reference alloy"), were subjected to a soaking treatment by holding the respective ingots at a temperature of 580° C. for a period of 24 hours, and then, the both surfaces of these ingots were mechanically shaved by 5 mm.

The three surface-shaved ingots thus having a thickness of 440 mm were hot rolled at a temperature of 510° C. to a thickness of 8 mm, and then, further rolled to a thickness of 2 mm by a primary cold rolling. Subsequently, after a primary annealing applied by holding at a temperature of 400° C. for a period of one hour, the samples were further rolled to a thickness of 0.5 mm through a secondary cold rolling. Then, after the application of a secondary anneling under the same conditions as in said primary annealing, the samples were rolled to a thickness of 0.15 mm by a final cold rolling. Bare sheets having a thickness of 0.15 mm respectively of the alloys A and B of the present invention and the reference alloy were thus prepared. The reference alloy thus prepared corresponds to the 7072 alloy of AA Standard which is generally considered to exhibit a relatively good sacrificial anode property.

An Al-9.5% Si-1.5% Mg alloy (X 4004 alloy of AA Standard) sheet having a thickness of 55 mm was laid, as a brazing material, on the both surfaces of each of another three surface-shaved ingots with a thickness of 440 mm as mentioned above. The assemblies thus made were tack-welded by spot-welding the four corners of the both surfaces, i.e., at eight points, and then rolled under the same conditions as in the preparation of the aforementioned bare sheets. Clad sheets with a thickness of 0.15 mm of the alloys A and B of the present invention and the reference alloy respectively in combination with the brazing material were thus prepared (hereinafter referred to as the "clad sheet").

A high-temperature sagging resistance test and a sacrificial anode property test were carried out on the bare sheets and the clad sheets of the alloys A and B of the present invention and the reference alloy thus prepared.

(1) High-temperature sagging resistance test

Test pieces each having a length of 60 mm, a width of 15 mm and a thickness of 0.15 mm were cut respectively from the bare sheets and the clad sheets of the alloys A and B of the present invention and the reference alloy prepared as mentioned above. Each of said test pieces 1 was horizontally fixed to a stand 2 made of stainless steel so that a half the length thereof protrudes from said stand 2, as shown in the schematic side view of FIG. 1.

Then, said test piece 1 was heated under either of the following conditions:

(a) heating to a temperature of 600° C. and holding respectively for 1 minute, 2 minutes and 3 minutes; and
(b) heating respectively to a temperature of 560° C., 580° C., 600° C. and 620° C., and holding for 3 minutes;

and the sag value, "t" mm, of said test piece 1 was measured. Results of measurement mentioned above are shown in Tables 1 and 2.

Table 1

| Kind of test piece | | Sag value (mm) (heated and held at 600° C.) Heated and held for 1 min. | Heated and held for 2 min. | Heated and held for 3 min. | Heated and held for 5 min. |
|---|---|---|---|---|---|
| Bare sheet | Alloy A of the present invention | 0.5 | 0.5 | 1.0 | 1.5 |
| | Alloy B of the present invention | 0.5 | 0.5 | 1.0 | 1.0 |
| | Reference alloy | 3.0 | 3.5 | 4.5 | 6.5 |
| Clad sheet | Alloy A of the present invention | 1.5 | 1.5 | 2.0 | 3.5 |
| | Alloy B of the present invention | 1.5 | 1.0 | 1.5 | 2.0 |
| | Reference alloy | 14.5 | 16.0 | 19.5 | 24.5 |

Table 2

| Kind of test piece | | Sag value (mm) (heated and held for 3 minutes) Heated and held at 560° C. | Heated and held at 580° C. | Heated and held at 600° C. | Heated and held at 620° C. |
|---|---|---|---|---|---|
| Bare sheet | Alloy A of the present invention | 0.5 | 0.5 | 1.0 | 2.0 |
| | Alloy B of the present invention | 0.5 | 0.5 | 1.0 | 1.5 |
| | Reference alloy | 2.0 | 3.0 | 4.5 | 7.5 |
| Clad sheet | Alloy A of the present invention | 0.5 | 1.5 | 2.0 | 3.5 |
| | Alloy B of the present invention | 0.5 | 1.0 | 1.5 | 2.5 |
| | Reference alloy | 12.5 | 15.0 | 19.5 | 28.0 |

As is evident from the results of measurment shown in Tables 1 and 2, the alloys A and B of the present invention show a high-temperature sagging resistance far superior to that of the reference alloy in all the cases of the bare sheets and the clad sheets.

A fin material with a sag value of up to 5 mm when held for 3 to 5 minutes at any of the temperature shown in Tables 1 and 2 is generally considered serviceable in the vacuum brazing method. The clad sheets made of the reference alloy, which show a sag value of at least 12.5 mm under all the conditions, are therefore less serviceable. Among the bare sheets made of the reference alloy, only those heated and held for a period of up to 3 minutes are considered practicable.

On the contrary, in the case of the alloys A and B of the present invention, even the clad sheets show a maximum sag value of only 3.5 mm. This reveals that the alloys of the present invention have an excellent high-temperature sagging resistance in both of the bare sheets and the clad sheets. As is clear also from Tables 1 and 2, the alloy B of the present invention containing zirconium shows a higher high-temperature sagging resistance than that of the alloy A of the present invention not containing zirconium, especially under conditions including heating at a high-temperature for a long period of time.

(2) Sacrificial anode property test

Figure 2:
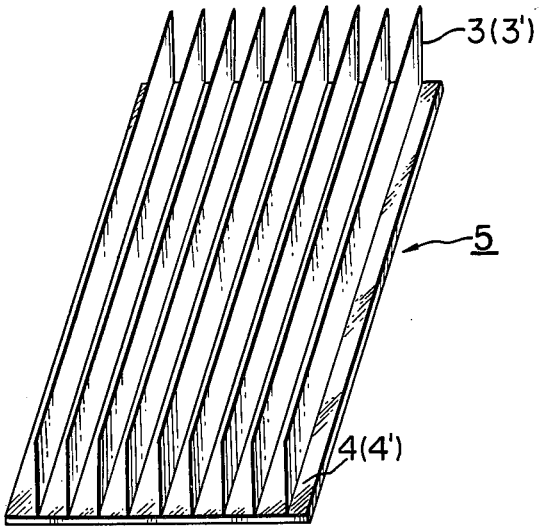
FIG. 2 is a schematic perspective view illustrating an assembly for testing the sacrificial anode property of a fin material.

Nine test pieces each having a length of 140 mm, a width of 20 mm and a thickness of 0.15 mm were cut respectively from the bare sheets and the clad sheets of the alloys A and B of the present invention and the reference alloy prepared as mentioned above. As shown in the schematic perspective view of FIG. 2, said nine test pieces 3 and 3' were substantially vertically tacked at intervals of 7 mm onto the upper surface of flat plate 4 or 4' having a length of 140 mm, a width of 70 mm and a thickness of 1.0 mm, by the use of an appropriate jig (not shown), to form and assembly 5 for testing the sacrificial anode property. In this assembly, in the case of the test piece 3 representing the bare sheet, a clad sheet 4 was used as said flat sheet, which was formed by applying an X4004 (Al-9.5% Si-1.5% Mg) alloy of AA Standard as the brazing material onto the upper surface of a 3003 (Al-1.2% Mn) alloy of AA Standards, whereas, in the case of the test piece 3' representing the clad sheet, a bare sheet 4' of 1050 aluminum (aluminum of a purity of at least 99.5%) of AA Standard, was used as said flat sheet.

Then, said nine test pieces 3 or 3' were substantially vertically brazed onto the upper surface of the flat plate 4 or 4' by the application of the aforementioned conventional vacuum brazing method to said assembly 5.

Then, said assembly 5 thus applied with the vacuum brazing method was subjected to a corrosion test of a cycle of one hours, which comprises dipping said assembly into a 5% salt bath at a temperature of 30° C. for 10 minutes, then immediately removing it from said salt bath and subjecting it to a forced drying for a period of 50 minutes. After carrying out this corrosion test for a period of 90 consecutive days, the condition of corrosion pits produced on the surface of said flat plate 4 or 4' on the side having said brazed test pieces 3 or 3' was observed. Results of this observation are given in Table 3.

Table 3

| Kind of test piece | | Condition of pits produced on the surface of the flat plate on the side having the brazed test pieces of the assembly for testing the sacrificial anode property: Density of corrosion pits (pits/dm$^2$) | Maximum depth of corrosion pit (mm) | Average depth of corrosion pit (mm) |
|---|---|---|---|---|
| Bare sheet | Alloy A of the present invention | 0 | 0 | 0 |
| | Alloy B of the present invention | 0 | 0 | 0 |
| | Reference alloy | 337 | 0.16 | 0.09 |
| Clad sheet | Alloy A of the present invention | 0 | 0 | 0 |
| | Alloy B of the present invention | 0 | 0 | 0 |
| | Reference alloy | 182 | 0.24 | 0.16 |

As is evident from the result of observation shown in Table 3, in the both alloys A and B of the present invention in the both cases of the bare sheets and the clad sheets, the vacuum atmosphere and the high-temperature during vacuum brazing never causes degradation of the sacrificial anode property, keeping an excellent sacrificial anode property, and consequently no corrosion pit occurs on the surfaces of the counterpart flat plate.

In contrast to this, in the reference alloys in the both cases of the bare sheets and the clad sheets, the vacuum atmosphere and the high-temperature during vacuum brazing impair the sacrificial anode property because of the evaporation of the substantial portion of zinc content, and as a result, many corrosion pits are produced on the surface of the counterpart flat plate.

As mentioned above in detail, the aluminum alloy of the present invention, which is excellent in the high-temperature sagging resistance and the sacrificial anode property, is adapted to be used as a fin material for a tube forming a composing member of a radiator or a condenser, thus providing industrially useful effects as follows:

(1) Because of the excellent high-temperature sagging resistance of the aluminum alloy of the present invention, fins never sag down and deform under high-temperatures during vacuum brazing, thus producing no irregularity in the intervals between fins. This leads to more uniform and more efficient cooling and heating, and hence improves the performance of a heat exchanger.

(2) Since the aluminum alloy of the present invention has an excellent sacrificial anode property, without being impaired by the vacuum atmosphere and the high-temperature during vacuum brazing, a pipe may satisfactorily be protected against corrosion thus extending the service life of a heat exchanger.

What is claimed is:

1. An aluminum alloy excellent in the high-temperature sagging resistance and the sacrificial anode property, which consists essentially of, in weight percentage:

zinc: from 0.5 to 8.0%, manganese from 0.5 to 1.5%, and the balance aluminum and incidental impurities;

said alloy being particularly adapted to be used as a fin material for a tube of a heat exchanger.

2. The aluminum alloy as claimed in claim 1, wherein said alloy also contains zirconium of from 0.01 to 0.5% in weight percentage.

* * * * *